US005331305A

United States Patent [19]

Kanbara et al.

[11] Patent Number: 5,331,305

[45] Date of Patent: Jul. 19, 1994

[54] CHIP NETWORK RESISTOR

[75] Inventors: Shigeru Kanbara; Toshihiro Hanamura, both of Kyoto, Japan

[73] Assignee: Rohm Co., Ltd., Kyoto, Japan

[21] Appl. No.: 51,091

[22] Filed: Apr. 21, 1993

[30] Foreign Application Priority Data

Jun. 1, 1992 [JP] Japan ..... 4-140445

[51] Int. Cl.[5] ..... H01C 1/14

[52] U.S. Cl. ..... 338/322; 338/309; 338/332

[58] Field of Search ..... 338/309, 322, 332

[56] References Cited

U.S. PATENT DOCUMENTS 4,829,553 5/1989 Shindo et al. ..... 338/309

*Primary Examiner*—Marvin M. Lateef

*Attorney, Agent, or Firm*—Brumbaugh, Graves, Donohue & Raymond

[57] ABSTRACT

A chip network resistor includes a plurality of discrete electrodes and common electrodes which are connected to a plurality of resistance elements according to a predetermined pattern. The configuration of the common electrodes is larger more than that of the discrete electrodes. Thereby, the contact resistance between the terminal of a measuring instrument and a common electrode is reducible when a value of resistance is measured.

8 Claims, 2 Drawing Sheets

CHIP NETWORK RESISTOR

BACKGROUND OF THE INVENTION

The present invention relates to improvements in the chip network resistor.

FIG. 3 shows an equivalent circuit of a chip network resistor having a plurality of common electrodes (common lines). This resistor comprises eight resistance elements R1 to R8 which have been so integrated as to form a plurality (two in this case) of common electrodes T1, T6 and discrete electrodes T2 to T5, and T7 to T10. When the value of resistance of the resistance element R1, for example, of this resistor is measured, the terminal of a measuring instrument is brought into contact with the common electrode T1 and the discrete electrode T10 or the common electrode T6 and the discrete electrode T10. As stated above, there are two ways of measuring the value of resistance of each resistance element of the resistor.

Assuming the value of resistance of the resistance element R1, for instance, remains at a specific value even in a case where the value of resistance is so low that the measurement os greatly affected by the contact resistance between the terminal of a measuring instrument and the electrode of the resistor, the contact resistance between the electrodes T6 - T10 may be great enough to render faulty the result measured between the electrodes T6 to T10 even when a specific value of resistance is measured between the electrodes T1 to T10. If the value of resistance varies with the location of the measurement, the fabrication yield may decrease.

SUMMARY OF THE INVENTION

An object of the present invention is to provide a chip network resistor such that when a value of resistance is measured, the contact resistance between the terminal of a measuring instrument and a common electrode is reducible.

In order to accomplish the object above, a chip network resistor according to the present invention comprises a common electrode having a larger width than that of any discrete electrode to ensure that the common electrode and the terminal of a measuring instrument come in contact with each other. Faulty measurement can thus be reduced.

DETAILED DESCRIPTION OF PREFERRED EMBODIMENT

Referring to the accompanying drawings, a description will subsequently be given of a chip network resistor embodying the present invention.

Figure 1:
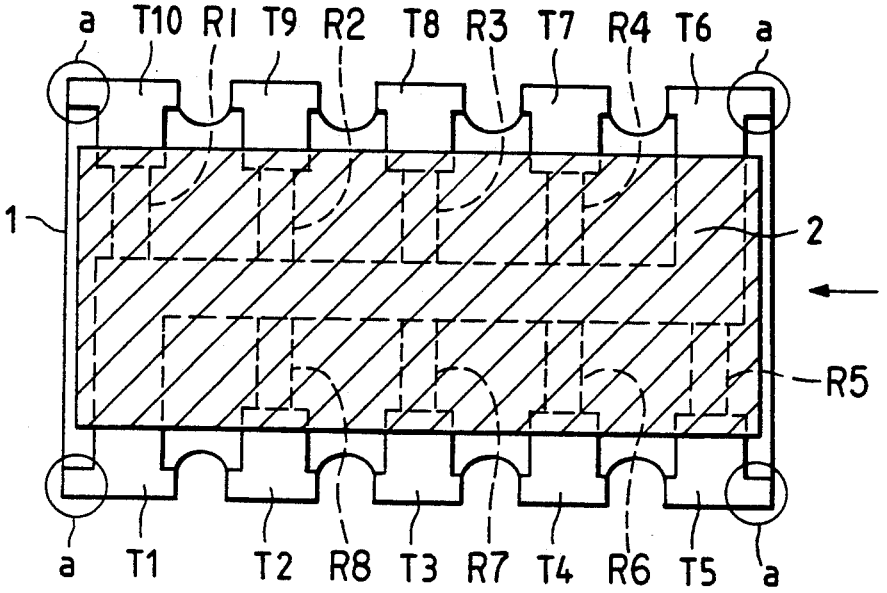
FIG. 1 is a top view of a chip netowork resistor of an embodiment of the present invention.
Figure 2:
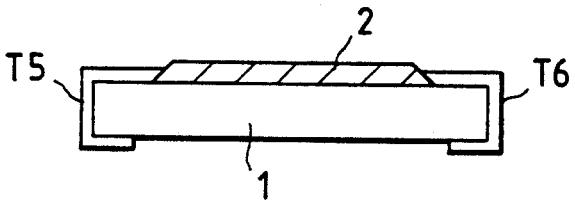
FIG. 2 is a side view of the resistor as viewed from an arrow of FIG. 1.
Figure 3:
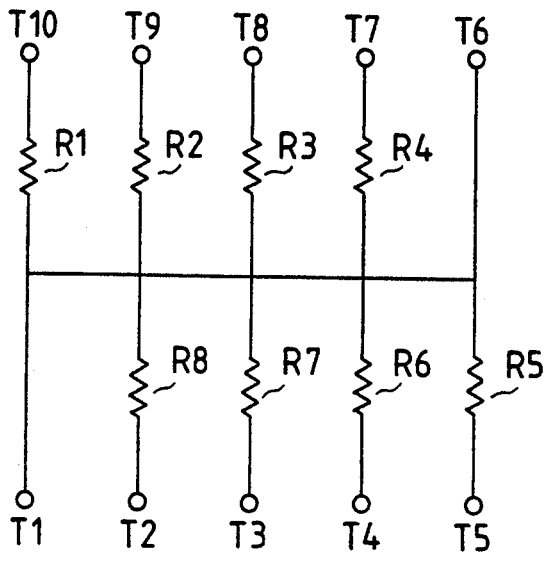
FIG. 3 is an equivalent circuit diagram of the resistor shown in FIG. 1.

FIG. 1 is a top view of a resistor embodying the present invention and FIG. 2 is a side view of the resistor as viewed from an arrow of FIG. 1. The resistor has an equivalent circuit of FIG. 3 and also has an internal structure similar to that of any ordinary one. More specifically, the resistor comprises eight resistance elements R1 to R8, shown in dotted outline, common electrodes T1, T6 connected to the respective resistance elements according to a predetermined pattern and discrete electrodes T2 to T5, T7 to T10, these elements and electrodes being formed on a substrate 1 and covered with a protective layer 2.

As shown in FIGS. 1 and 2, the common electrodes T1, T6 and the discrete electrodes T5, T10 which are located in the respective corner portions, and width thereof is greater than that of the discrete electrodes T2 to T4, T7 to T9. Therefore, surface area becomes large. In other words, the portion a marked with a circle is slightly outwardly protruded from the resistor. When the value of resistance of the resistance element R1, for example, is measured, the terminal of a measuring instrument can be made to contact the common electrode T1 or T6 to ensure that the contact resistance is lowered. Even though the value of resistance is measured between the common electrode T1 and the discrete electrode T10 or the common electrode T6 and the discrete electrode T10, the difference in that value therebetween is minimized and so is the faulty measurement.

The expanded configuration of the common electrodes T1, T6 and the discrete electrodes T5, T10 in the embodiment shown solely represents one example of many and may be modified as long as the contact resistance is reducible.

According to the invention, the expanded electrodes may be located at the corner portions of the chip network resistor. Therefore, the pitch of electrode terminals is unchanged. Accordingly, the terminals of a measuring instrument conventionally used can be used to measure the resistance of the chip network resistor according to the present invention.

Figure 4:
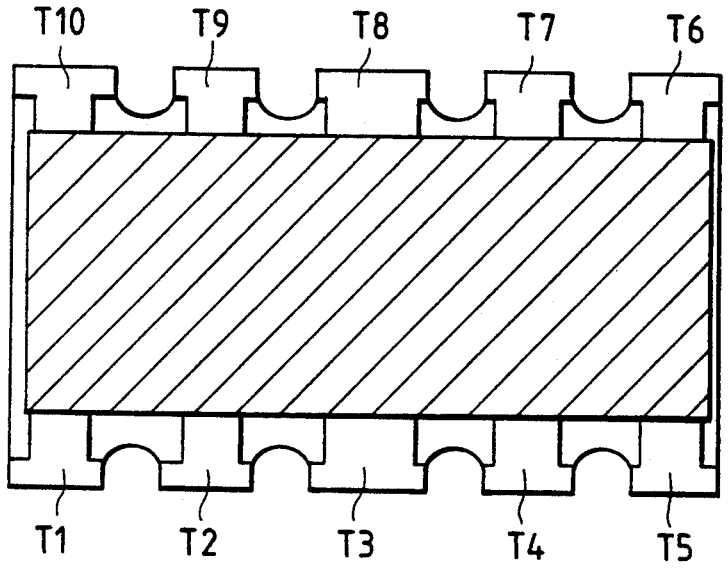
FIG. 4 is a top view of a chip network resistor of another embodiment of the present invention.

Furthermore, according to the invention, the configuration of the chip network resistor may be made symmetrically as shown in FIG. 4. In this embodiment, terminal T3 and T8 are common electrodes. By such configuration, the measurement terminal can be prevented from short-circuiting with neighbor terminal by the measurement terminal, even if an orientation of the resistor is erred when measuring resistance of the chip network resistor.

Furthermore, according to the invention, an internal pattern of the common electrode can be expand as same as the common electrode terminal. Thereby, resistance of the internal pattern can also decreased. As a result, increasing the fabrication yield is expected.

Furthermore, according to the invention, four corners of the chip net work resistor may be made angular in shape. Such rectangular shape of the resistor is preferable for image analysis because only four corners are recognized to detect the position of the resistor. Thereby, it is easy to mount with high accuracy and high speed by image analysis.

As set forth above, the common electrodes of the chip network resistor, according to the present invention, whose width is larger than that of the discrete electrodes to ensure that the terminals of a measuring instrument comes in contact with the common electrode when the value of resistance of the resistance element is measured. The contact resistance can thus be lowered with the effect of decreasing faulty measurement while increasing the fabrication yield.

What is claimed is:

1. A chip network resistor comprising:

a plurality of resistance elements;

at least one common electrode connected to all of the respective resistance elements;

a plurality of discrete electrodes, each connected to a corresponding one of said resistance elements; and a substrate on which the resistance elements, the common electrode and the discrete electrodes are formed and a protective layer covering the resistance elements;

wherein the common electrode has a width which is larger than that of any of the discrete electrodes and is located at a corner portion of the chip network resistor.

2. A chip network resistor as claimed in claim 1, wherein at least one of said discrete electrodes is located at a corner portion of the chip network resistor and has a width which is larger than that of other discrete electrodes.

3. A chip network resistor as claimed in claim 1, wherein four corners of said chip network resistor have an angular shape.

4. A chip network resistor as claimed in claim 1, wherein the chip network resistor has a symmetric configuration of resistance elements and common electrodes.

5. A chip network resistor comprising:

a plurality of resistance elements;

at least one common electrode connected to all of the respective resistance elements;

a plurality of discrete electrodes, each connected to a corresponding one of said resistance elements; and a substrate on which the resistance elements, the common electrode and the discrete electrodes are formed and a protective layer covering the resistance elements;

wherein the common electrode has a width which is larger than that of any of the discrete electrodes, and is located at the center of the chip network resistor.

6. A chip network resistor as claimed in claim 5, wherein at least one of said discrete electrodes is located at a corner portion of the chip network resistor and has a width which is larger than that of the other discrete electrodes.

7. A chip network resistor as claimed in claim 6, wherein four corners of said chip network resistor have an angular shape.

8. A chip network resistor as claimed in claim 6, wherein the chip network resistor has a symmetric configuration of resistance elements and common electrodes.

* * * * *

UNITED STATES PATENT AND TRADEMARK OFFICE

CERTIFICATE OF CORRECTION

PATENT NO. : 5,331,305

DATED : July 19, 1994

INVENTOR(S) : Shigeru Kanbara et al.

It is certified that error appears in the above-identified patent and that said Letters Patent is hereby corrected as shown below:

5th line of Abstract:

Delete "more".

Column 1, line 24: The word "os" should read --is--.

Column 2, line 61: The word "terminals" should read --terminal--.

Column 4, line 19: The words "claim 6" should read --claim 5--; line 22: The words "claim 6" should read --claim 5--.

Signed and Sealed this

Eighth Day of November, 1994

Bruce Lehman

BRUCE LEHMAN

*Commissioner of Patents and Trademarks*

*Attest:*

*Attesting Officer*

UNITED STATES PATENT AND TRADEMARK OFFICE

CERTIFICATE OF CORRECTION

PATENT NO. : 5,331,305

DATED : July 19, 1994

INVENTOR(S) : Shigeru Kanbara et al.

It is certified that error appears in the above-indentified patent and that said Letters Patent is hereby corrected as shown below:

Column 3, line 15, "of said discrete electrodes" should read --further discrete electrode--.

Column 4, line 15, "of said discrete electrodes" should read --further discrete electrode--.

Signed and Sealed this

Eighth Day of August, 1995

Bruce Lehman

*Attest:*

BRUCE LEHMAN

*Attesting Officer*

*Commissioner of Patents and Trademarks*

US005331305B1

REEXAMINATION CERTIFICATE (3029th)

United States Patent [19] [11] B1 5,331,305

Kanbara et al. [45] Certificate Issued Oct. 15, 1996

[54] CHIP NETWORK RESISTOR

[75] Inventors: Shigeru Kanbara; Toshihiro Hanamura, both of Kyoto, Japan

[73] Assignee: Rohm Co., Ltd., Kyoto, Japan

Reexamination Request:
No. 90/003,999, Oct. 16, 1995

Reexamination Certificate for:

| | |
|---|---|
| Patent No.: | **5,331,305** |
| Issued: | **Jul. 19, 1994** |
| Appl. No.: | **51,091** |
| Filed: | **Apr. 21, 1993** |

Certificate of Correction issued Nov. 8, 1994.
Certificate of Correction issued Aug. 8, 1995.

[30] Foreign Application Priority Data

Jun. 1, 1992 [JP] Japan ..... 4-140445

[51] Int. Cl.[6] ..... H01C 1/14

[52] U.S. Cl. ..... 338/322; 338/309; 338/332

[58] Field of Search ..... 338/307–309, 338/322, 324, 325, 327, 332; 29/610

[56] References Cited

U.S. PATENT DOCUMENTS 4,829,553 5/1989 Shindo et al. ..... 338/309

FOREIGN PATENT DOCUMENTS 61-142402 of 1986 Japan .
3-92006 of 1991 Japan .

*Primary Examiner*—Tu Hoang

[57] ABSTRACT

A chip network resistor includes a plurality of discrete electrodes and common electrodes which are connected to a plurality of resistance elements according to a predetermined pattern. The configuration of the common electrodes is larger more than that of the discrete electrodes. Thereby, the contact resistance between the terminal of a measuring instrument and a common electrode is reducible when a value of resistance is measured.

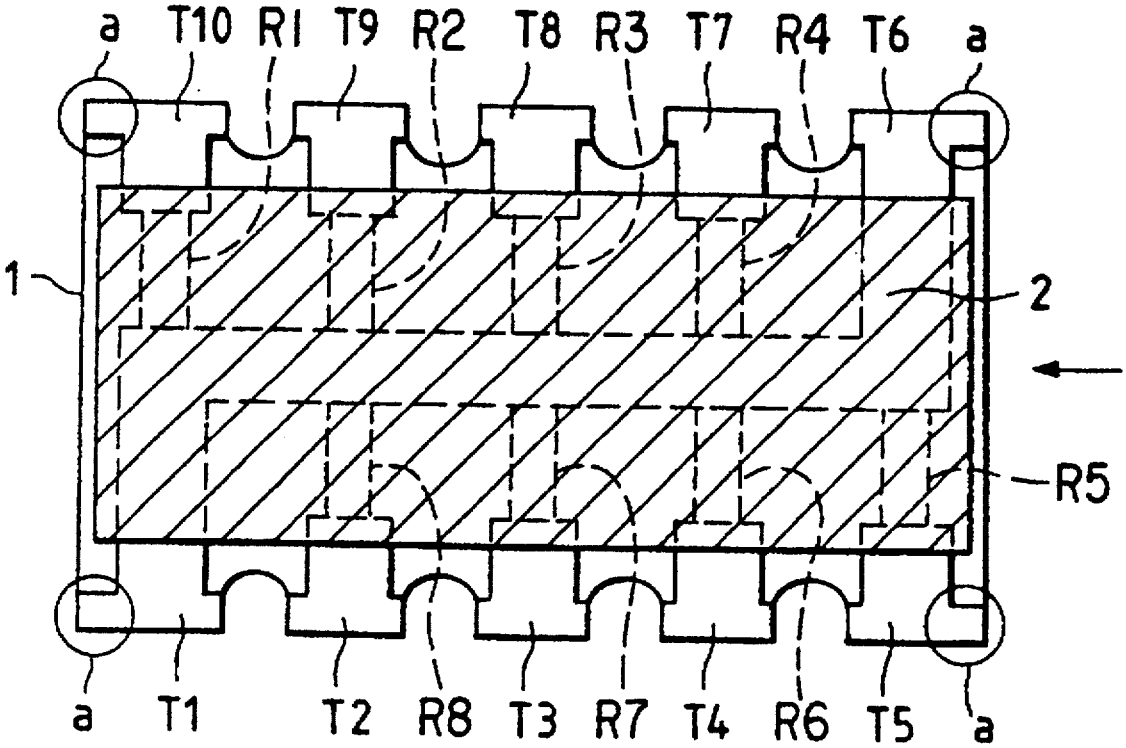

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3 and 7 are cancelled.

Claims 1 and 5 are determined to be patentable as amended.

Claims 2, 4, 6 and 8, dependent on an amended claim, are determined to be patentable.

1. A chip network resistor comprising:

a plurality of resistance elements;

at least one common electrode connected to all of the respective resistance elements;

a plurality of discrete electrodes, each connected to a corresponding one of said resistance elements; and a substrate on which the resistance elements, the common electrode and the discrete electrodes are formed and a protective layer covering the resistance elements;

wherein *each discrete electrode has a width which is larger than that of the corresponding resistance element and* the common electrode has a width which is larger than that of any of the discrete electrodes and is located at a corner portion of the chip network resistor[.], *and*

*wherein four corners of said chip network have an angular shape.*

5. A chip network resistor comprising:

a plurality of resistance elements;

at least one common electrode connected to all of the respective resistance elements;

a plurality of discrete electrodes, each connected to a corresponding one of said resistance elements; and a substrate on which the resistance elements, the common electrode and the discrete electrodes are formed and a protective layer covering the resistance elements;

wherein *each discrete electrode has a width which is larger than that of the corresponding resistance element and* the common electrode has a width which is larger than that of any of the discrete electrodes, and is located at the center of the chip network resistor[.], *and*

*wherein four corners of said chip network have an angular shape.*

* * * * *